US009140031B2

(12) United States Patent
Fields

(10) Patent No.: US 9,140,031 B2
(45) Date of Patent: Sep. 22, 2015

(54) MODULAR TENT DOOR ASSEMBLY WITH COLLAPSIBLE FRAME

(71) Applicant: Joseph William Fields, Oneida, TN (US)

(72) Inventor: Joseph William Fields, Oneida, TN (US)

(73) Assignee: Outdoor Venture Corp., Stearns, KY (US)

( * ) Notice: Subject to any disclaimer, the term of this patent is extended or adjusted under 35 U.S.C. 154(b) by 209 days.

(21) Appl. No.: 13/693,948

(22) Filed: Dec. 4, 2012

(65) Prior Publication Data

US 2013/0139863 A1 Jun. 6, 2013

Related U.S. Application Data

(60) Provisional application No. 61/566,840, filed on Dec. 5, 2011.

(51) Int. Cl.

| | |
|---|---|
| ***E04H 15/58*** | (2006.01) |
| ***E04H 15/32*** | (2006.01) |
| *E04H 15/54* | (2006.01) |
| *E04H 15/64* | (2006.01) |

(52) U.S. Cl.

CPC ..... *E04H 15/58* (2013.01); *E04H 15/32* (2013.01); *E04H 15/54* (2013.01); *E04H 15/642* (2013.01)

(58) Field of Classification Search

CPC ..... E04H 15/58

USPC ..... 135/117; 160/371, 180; 52/2.11, 5

See application file for complete search history.

(56) References Cited

U.S. PATENT DOCUMENTS

| | | | | |
|---|---|---|---|---|
| 1,656,545 | A * | 1/1928 | Tuthill | 52/63 |
| 1,704,945 | A * | 3/1929 | Leffert | 135/117 |
| 3,513,862 | A * | 5/1970 | Pohl et al. | 135/117 |
| 3,744,501 | A * | 7/1973 | Kozarsky | 52/2.12 |
| 4,067,347 | A * | 1/1978 | Lipinski | 126/624 |
| 5,393,598 | A * | 2/1995 | Schlecker | 442/186 |
| 5,660,112 | A * | 8/1997 | Theurer | 104/2 |
| 5,661,942 | A * | 9/1997 | Palmer | 52/653.2 |
| 6,390,112 | B1 * | 5/2002 | Christiansen | 135/143 |
| 6,981,540 | B2 * | 1/2006 | Deblois | 160/371 |
| 2006/0060235 | A1 * | 3/2006 | Ball | 135/136 |
| 2008/0210283 | A1 * | 9/2008 | Hinz et al. | 135/121 |

FOREIGN PATENT DOCUMENTS

CA 2304817 A1 * 11/2000

* cited by examiner

*Primary Examiner* — David R Dunn
*Assistant Examiner* — Danielle Jackson
(74) *Attorney, Agent, or Firm* — J. M. Robertson, LLC

(57) ABSTRACT

A tent door panel assembly incorporating a pliable, soft material operatively connected to collapsible tubular frame to define an internal swinging door. The door panel of pliable material may be connected to the door opening or vestibule opening of the tent using well known attachment mechanisms. The collapsible tubular frame may be disassembled and reassembled for removal and portability.

19 Claims, 6 Drawing Sheets

MODULAR TENT DOOR ASSEMBLY WITH COLLAPSIBLE FRAME

CROSS-REFERENCE TO RELATED APPLICATIONS

This nonprovisional application claims the benefit of, and priority from, U.S. provisional application 61/566,840 filed 5 Dec. 2011. The contents of such prior application and all patent documents referenced herein are hereby incorporated by reference in their entirety as if fully set forth herein.

TECHNICAL FIELD

The present disclosure relates generally to tents, and more specifically to a framed door panel structure including a swinging door which is attachable to a vestibule or door opening of a soft-walled tent.

BACKGROUND

The use of soft-walled tents for shelter is well known. Such structures have the benefits of light weight and portability which facilitates their use as mobile, temporary structures. In some instances, it may be necessary to use a tent for a prolonged period of time. In such circumstances, it may be desirable for the tent to exhibit characteristics of a more permanent structure to provide the user with a greater degree of comfort and security.

It is known to use a wooden or metal framework for the body of the tent. However, even in such framed structures, the entryway covering was typically a soft structure such as a flap or the like which did not mimic the action of a standard hinging door. Thus, a user did not have the perception of entering and leaving a permanent structure. It is also known to use solid wooden doors for operative connection to a tent frame. However, such structures are not highly portable due to substantial bulk and weight. Moreover, such structures may be relatively difficult to install in the field.

SUMMARY OF THE DISCLOSURE

The present disclosure provides advantages and alternatives over the prior art by providing a tent door panel assembly incorporating a pliable, soft material operatively connected to collapsible tubular frame to define an internal swinging door. The door panel of pliable material may be connected to the door opening or vestibule opening of the tent using well known attachment mechanisms. The collapsible tubular frame may be disassembled and reassembled for removal and portability.

In accordance with one exemplary aspect, the present disclosure provides a modular tent door panel adapted to be folded and unfolded for storage and shipment. The door panel includes a structural frame including a door skeleton defining a rotatable door adapted to rotate about a hinge line. The door skeleton includes a plurality of tube sections. One or more of the tube sections are multi-piece tube sections comprising multiple tube segments interconnected in releasable relation to one another along a length dimension such that the multi-piece tube sections have an enhanced length relative to the constituent tube segments. A pliable door skin panel is disposed in covering relation across one side of the door skeleton. The door skin panel is anchored in fixed relation to multiple tube segments forming a first outboard multi-piece tube section. The first outboard multi-piece tube section is positioned substantially parallel to the hinge line and outboard from the hinge line. The door skin panel is further anchored in fixed relation to multiple tube segments forming an inboard multi-piece tube section defining a free edge of the door oriented substantially parallel to the hinge line. A pliable side panel is anchored in fixed relation to multiple tube segments forming a second outboard multi-piece tube section. The second outboard multi-piece tube section is positioned substantially parallel to the hinge line and outboard from the free edge of the door when the door is in a closed position.

Other features and advantages of the disclosure will become apparent to those of skill in the art upon review of the following detailed description, claims and drawings.

Figure 1:
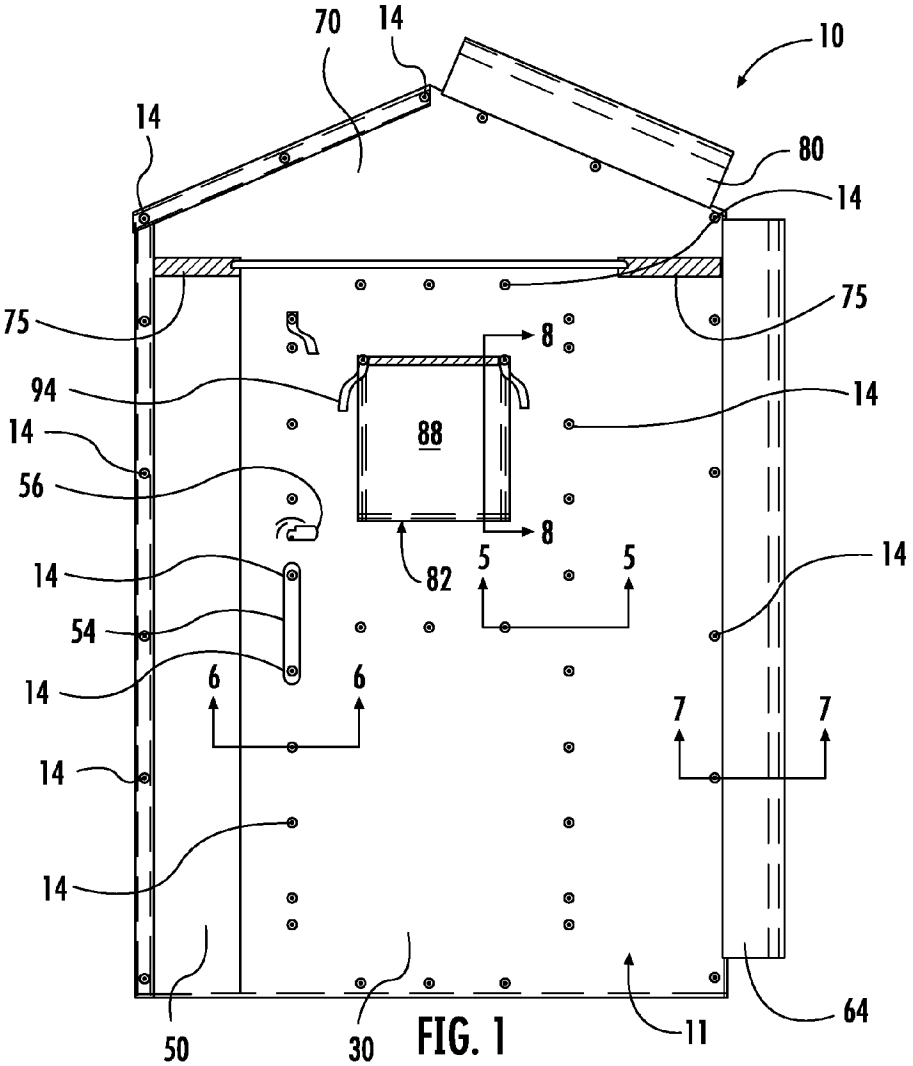
FIG. 1 is a schematic view illustrating the front surface (i.e. exterior) of a fully assembled exemplary modular tent door consistent with the present disclosure wherein fabric materials are disposed in attached covering relation to a collapsible frame.

Before the exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and of being practiced or being carried out in various ways.

DETAILED DESCRIPTION OF THE PREFERRED EMBODIMENTS

Reference will now be made to the drawings wherein, to the extent possible, like elements are designated by like reference numerals in the various views. The figures illustrate various views of a modular tent door assembly 10 adapted for operative connection at the inner perimeter of a tent mouth opening or vestibule (not shown) as will be well known to those of skill in the art. The door assembly 10 include includes an outer covering 11 made up of panels of synthetic fabric or the like (FIG. 9) disposed in overlying relation to a supporting door frame 12 (FIGS. 3 and 4) as will be described further hereinafter. In this regard, the outer covering is preferably formed from a pliable polymeric fabric material including an insulation layer as will be described further hereinafter, although different materials may be used if desired.

As best seen through joint reference to FIGS. 1-4, in the exemplary construction, the door frame 12 may be disposed across the surface of the door facing into the interior of the tent such that components of the door frame may be visible to an occupant in the tent. However, these components will typically be covered across the exterior so as to be substantially hidden from view at the exterior. By way of example only, and not limitation, the covering material may be affixed to the door frame by a multiplicity of rivets 14 extending through the covering material and into hollow tubes 16 of aluminum or other suitable tubular material forming the frame 12.

By way of example only, and not limitation, one or more of the tubes 16 may be formed from multiple tube segments of relatively short length connected by use of joints having a structure generally as shown and described in U.S. Pat. No. 6,726,255, the contents of which are hereby incorporated by reference in their entirety. However other suitable connection structures which can be engaged and disengaged may likewise be used if desired. As will be appreciated, by using relatively short length tube segments which can be reversibly connected and disconnected, the frame 12 may be disassembled, while individual tube segments may remain attached in riveted relation to the outer covering 11. Thus, when the frame 12 is disassembled, the door assembly 10 may be folded into a relatively compact structure without requiring complete disengagement of the covering from the tube segments.

Figure 4:
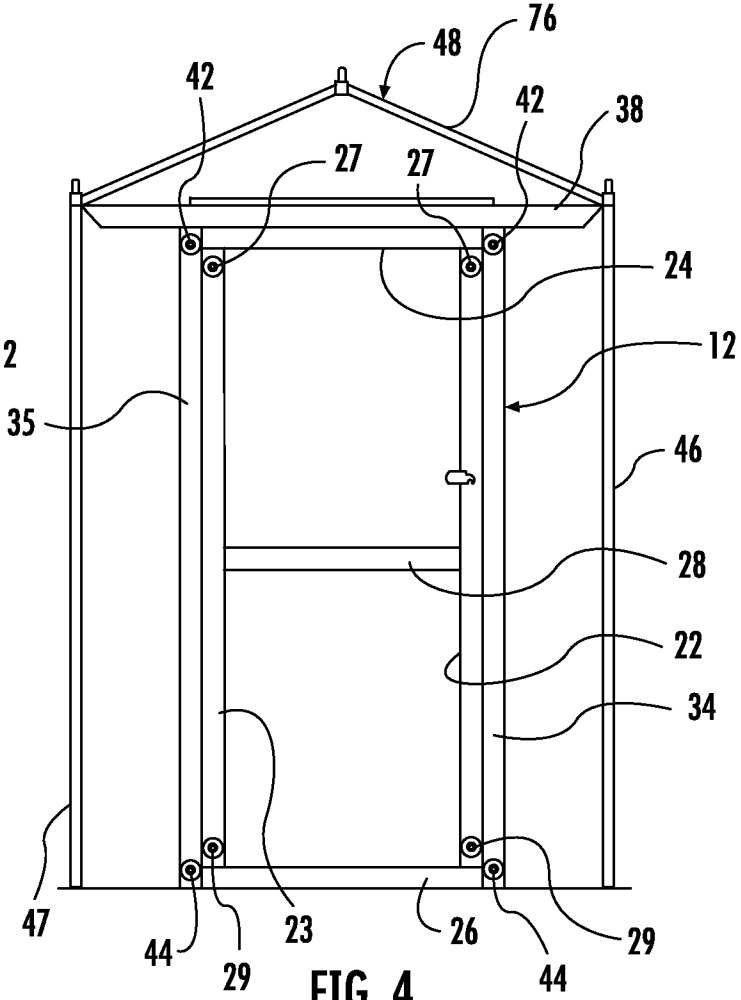
FIG. 4 is a schematic view similar to FIG. 2 illustrating the interior of a fully assembled supporting frame consistent with the present disclosure wherein fabric materials have been removed to illustrate the underlying support structure.
Figure 3:
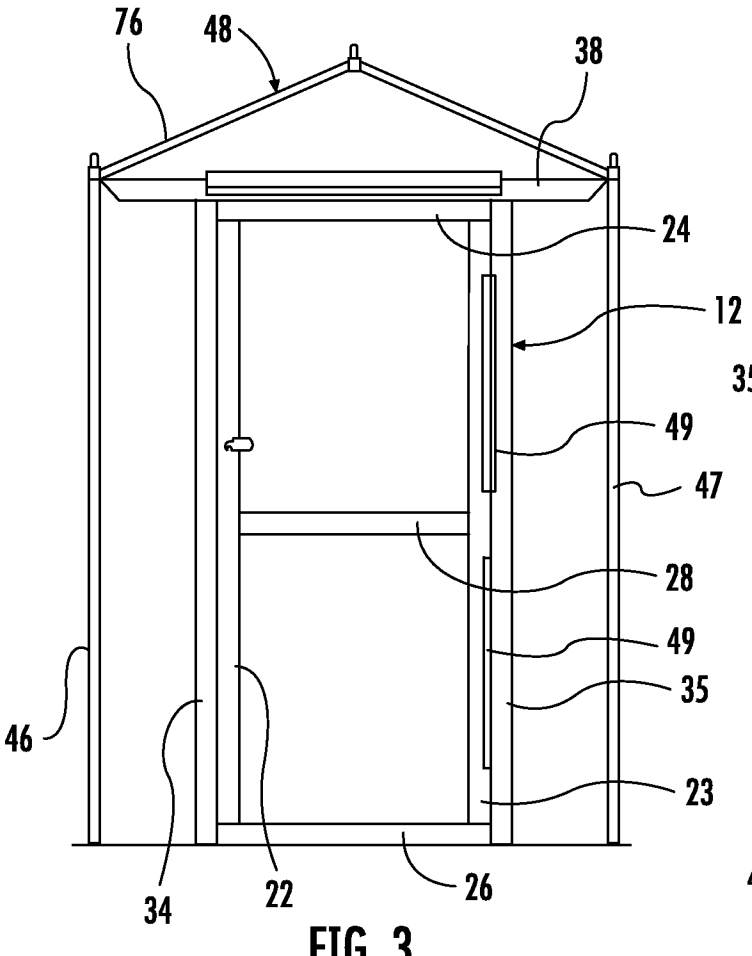
FIG. 3 is a schematic view similar to FIG. 1 illustrating the front face of a fully assembled supporting frame consistent with the present disclosure wherein fabric materials have been removed to illustrate the underlying support structure.
Figure 5:
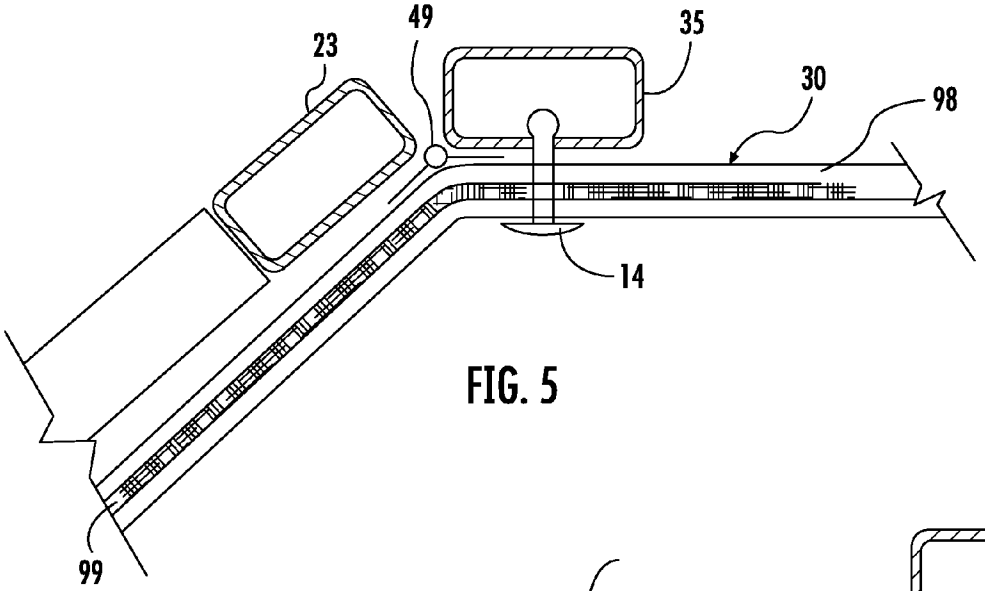
FIG. 5 is a sectional view taken generally along line 5-5 in FIG. 1 illustrating an exemplary hinge construction for an exemplary modular tent door consistent with the present disclosure.

A best seen in FIGS. 3-5, the frame 12 is configured to correspond generally to a standard door frame as would exist in a permanent structure. In this regard, the frame 12 includes a rotatable door skeleton 20 of substantially rectangular configuration. In the exemplary construction, the rotatable door skeleton 20 includes a first inboard lateral tube section 22 made up of one or more tube segments and a second inboard lateral tube section 23 made up of one or more tube segments forming opposite sides of the door skeleton 20. As will be readily understood, the first inboard lateral tube section 22 defines a free edge of the door skeleton 20 and the second inboard lateral tube section 23 defines a hinged edge of the door skeleton 20 as will be described further hereinafter. A top edge tube section 24 made up of one or more tube segments extends in crossing relation between the inboard lateral tube sections 22, 23 to define the top of the door skeleton 20. Likewise, a bottom edge tube section 26 made up of one or more tube segments extends in crossing relation between the inboard lateral tube sections 22, 23 to define the bottom of the door skeleton 20. A midline tube section 28 made up of one or more tube segments extends in crossing relation between the inboard lateral tube sections 22, 23 to define an intermediate support.

Figure 2:
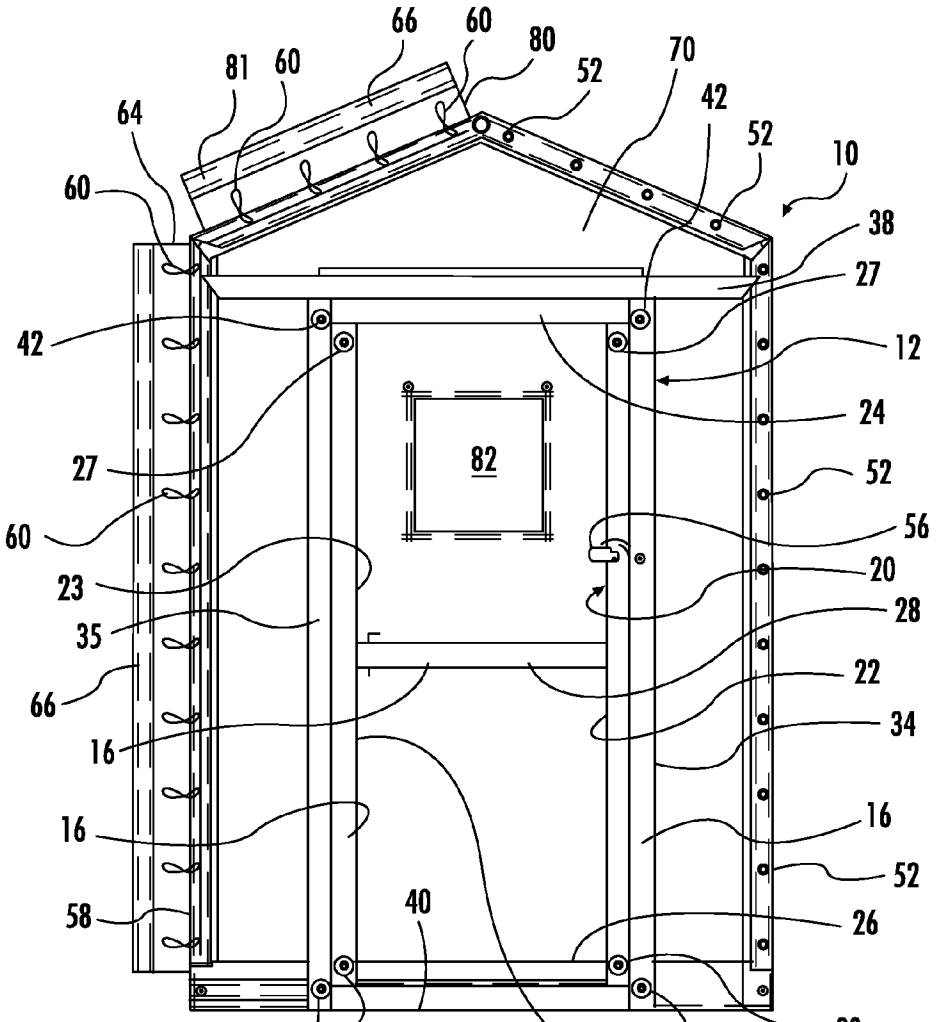
FIG. 2 is schematic view illustrating the interior surface of the fully assembled exemplary modular tent door of FIG. 1 wherein fabric materials are disposed in attached relation to a collapsible frame.

As best seen in FIG. 2, in the final construction a pair of removable top corner bolt connections 27 secures the inboard lateral tube sections 22, 23 to the top edge tube section. By way of example only, and not limitation, the connections between the top edge tube section 24 and the inboard lateral tube sections 22, 23 may be made by providing the top edge tube section 24 with a pair of short length ears (not shown) of tubing material which are matedly received in the corresponding inboard lateral tube sections 22, 23 and are then held in place by the top corner bolt connections 27. Of course, any other suitable connection technique as may be desired may likewise be used. A pair of removable bottom corner bolt connections 29 secures the inboard lateral tube sections 22, 23 to the bottom edge tube section 26. By way of example only, and not limitation, the connections between the bottom edge tube section 26 and the inboard lateral tube sections 22, 23 may be made by inserting the ends of the bottom edge tube section 26 into cutouts in the corresponding inboard lateral tube sections and then securing the bottom corner bolt connections 29 in place. Of course, any other suitable connection technique as may be desired may likewise be used.

Figure 6:
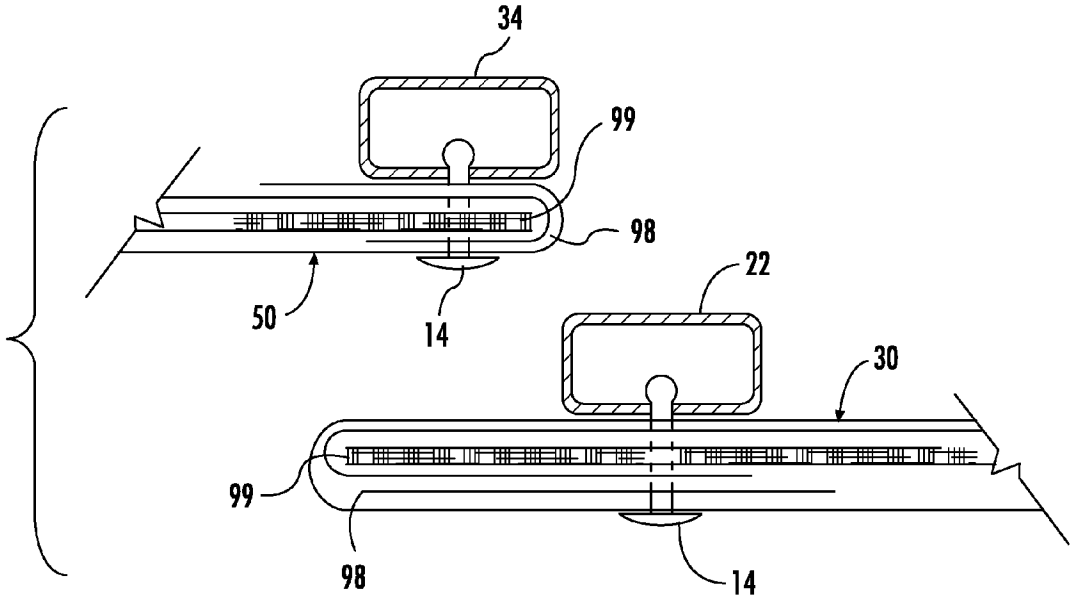
FIG. 6 is a sectional view taken generally along line 6-6 in FIG. 1 illustrating an exemplary overlapping door and jam arrangement for an exemplary modular tent door consistent with the present disclosure.

In the exemplary construction, a pattern of rivets 14 extends between a door skin panel 30 (FIG. 9) and the first inboard lateral tube section 22 (FIG. 6). Rivets 14 also extend between a door skin panel 30 and the top edge tube section 24, the bottom edge tube section 26 and the midline tube section 28. In this regard, the rivets 14 are disposed in spaced relation to one another at positions along the length dimension of the underlying tube sections. As best seen in FIG. 5, in the exemplary construction the door skin panel 30 is not riveted to the second inboard lateral tube section 23 adjacent the door hinge line. Rather, an operative connection between the second inboard lateral tube section 23 and the door skin panel 30 is established by a hinge connection as will be described further hereinafter.

As shown, the frame 12 further includes a stationary rim joist disposed in adjacent outboard relation to the door skeleton 20. In the exemplary construction, the stationary rim joist includes a first outboard lateral tube section 34 made up of one or more tube segments disposed in adjacent outboard relation to the first inboard lateral tube section 22. The stationary rim joist further includes a second outboard lateral tube section 35 made up of one or more tube segments disposed in adjacent outboard relation to the second inboard lateral tube section 23. As will be readily understood, the first outboard lateral tube section 34 defines a latching stop for the free edge of the door skeleton 20 and the second outboard lateral tube section 35 defines supporting anchor for the hinged edge of the door skeleton 20. A header tube 38 made up of one or more tube segments is disposed in crossing relation above the outboard lateral tube sections 34, 35. A footer tube section 40 made up of one or more tube segments is disposed in crossing relation between the first and second outboard lateral tube sections 34, 35.

As best seen in FIG. 2, in the final construction a pair of removable header bolt connections 42 secures the outboard lateral tube sections 34, 35 to the header tube 38. By way of example only, and not limitation, the connections between the header tube 38 and the outboard lateral tube sections 34, 35 may be made by providing the header tube 38 with a pair of short length ears (not shown) of tubing material which are matedly received in the corresponding outboard lateral tube sections 34, 35 and are then held in place by the header bolt connections 42. Of course, any other suitable connection technique as may be desired may likewise be used. A pair of removable footer bolt connections 44 secures the outboard lateral tube sections 34, 35 to the footer tube 40. By way of example only, and not limitation, the connections between the footer tube 40 and the outboard lateral tube sections 34, 35 may be made by inserting the ends of the footer tube 40 into cutouts in the corresponding outboard lateral tube sections 34, 35 and then securing the footer bolt connections 44 in place. Of course, any other suitable connection technique as may be desired may likewise be used.

As best seen in FIGS. 3 and 4, the frame 12 may further include a first vestibule leg pole 46 and a second vestibule leg pole 47 disposed on opposing lateral sides of the rotatable door 20. A peaked vestibule A-frame 48 extends upwardly from the leg poles 46, 47. The vestibule leg poles 46, 47 and the A-frame 48 may each be formed from an arrangement of hollow metal tubes as will be well known to those of skill in the art. As will be appreciated, the configuration of the vestibule leg poles 46, 47 and the A-frame 48 may substantially correspond to the opening of a tent such that the leg poles 46, 47 and the A-frame 48 may provide perimeter support when the door assembly 10 is installed. Of course, other perimeter geometries may be used depending on the configuration of the tent opening.

Referring now jointly to FIGS. 1 and 5, it may be seen that in the exemplary construction a line of rivets 14 extends between a door skin panel 30 and the second outboard lateral tube section 35. A pair of spring hinges 49 extends in connecting relation between the second inboard lateral tube section 23 and the second outboard lateral tube section 35. Thus, an operative connection is established between the door skin panel 30 and the rotatable door skeleton along the hinge line defined by the spring hinges 49. As will be appreciated through reference to FIG. 5, in the exemplary arrangement the portion of the door skin panel overlying the spring hinges 49 forms a living hinge which flexes as the door 20 swings on its axis.

Referring jointly to FIGS. 1 and 6, it can be seen that in the exemplary construction the first outboard lateral tube section 34 is secured to a fabric side panel 50 by a series of rivets 14 (only one shown) disposed in spaced relation along the length of the first outboard lateral tube section 34. In this regard, the rivets 14 extend through the fabric side panel 50 along an inboard edge and into the underlying first outboard lateral tube section 34. The fabric side panel 50 may be folded over onto itself and seamed to form a pocket adapted for receipt of the first vestibule leg pole 46. In the exemplary construction, the outboard edge of the fabric side panel 50 may include a pattern of rivets secured to grommets 52 (FIG. 2) adapted to provide a snap connection along one side of the tent opening.

As noted previously, the first outboard lateral tube section 34 defines a latching stop for the free edge of the hinge-mounted door skeleton 20. Accordingly, in the final construction, when the rotatable door 20 is closed, the opposing surfaces of the door skin panel 30 and the first fabric side panel 50 will be in close overlapping relation (FIG. 6). If desired, an optional handle 54 in the form of a strip of fabric or the like may be secured to the exterior of the door skin panel 30 to facilitate opening. According to the illustrated exemplary construction, the handle 54 may be mounted by rivets 14 to the underlying inboard lateral tube section 22 so as to promote stability. An optional latch 56 also may be provided to prevent unwanted opening of the rotatable door 20.

In the exemplary construction, the portion of the door skin panel 30 extending outboard from the second outboard lateral tube section 35 may be folded over onto itself and seamed to form a pocket adapted for receipt of the second vestibule leg pole 47. As best seen through joint reference to FIGS. 1 and 7, the outboard edge of the door skin panel 30 may include a pattern of rivets 14 and may be seamed or otherwise secured to a loop support flap 58 supporting an arrangement of Becket loops 60 adapted to be joined in cinched relation to the perimeter of the tent vestibule opening in a manner as will be well known to those of skill in the art.

So as to promote a weather-tight covering at the location of the Becket loop attachments, a barrier flap 64 of PVC coated polyester fabric or the like extends outboard from the edge of door skin panel 30 adjacent the location of the Becket loops. As shown, the barrier flap 64 includes a flap connection element 66 along its free edge. By way of example only, the flap connection element may be one half of a hook and loop fabric connection such that the barrier flap may be folded over the Becket loops and be attached to a complementary element on the surface of the door skin panel 30. An effective weather cover may thus be established.

Figure 9:
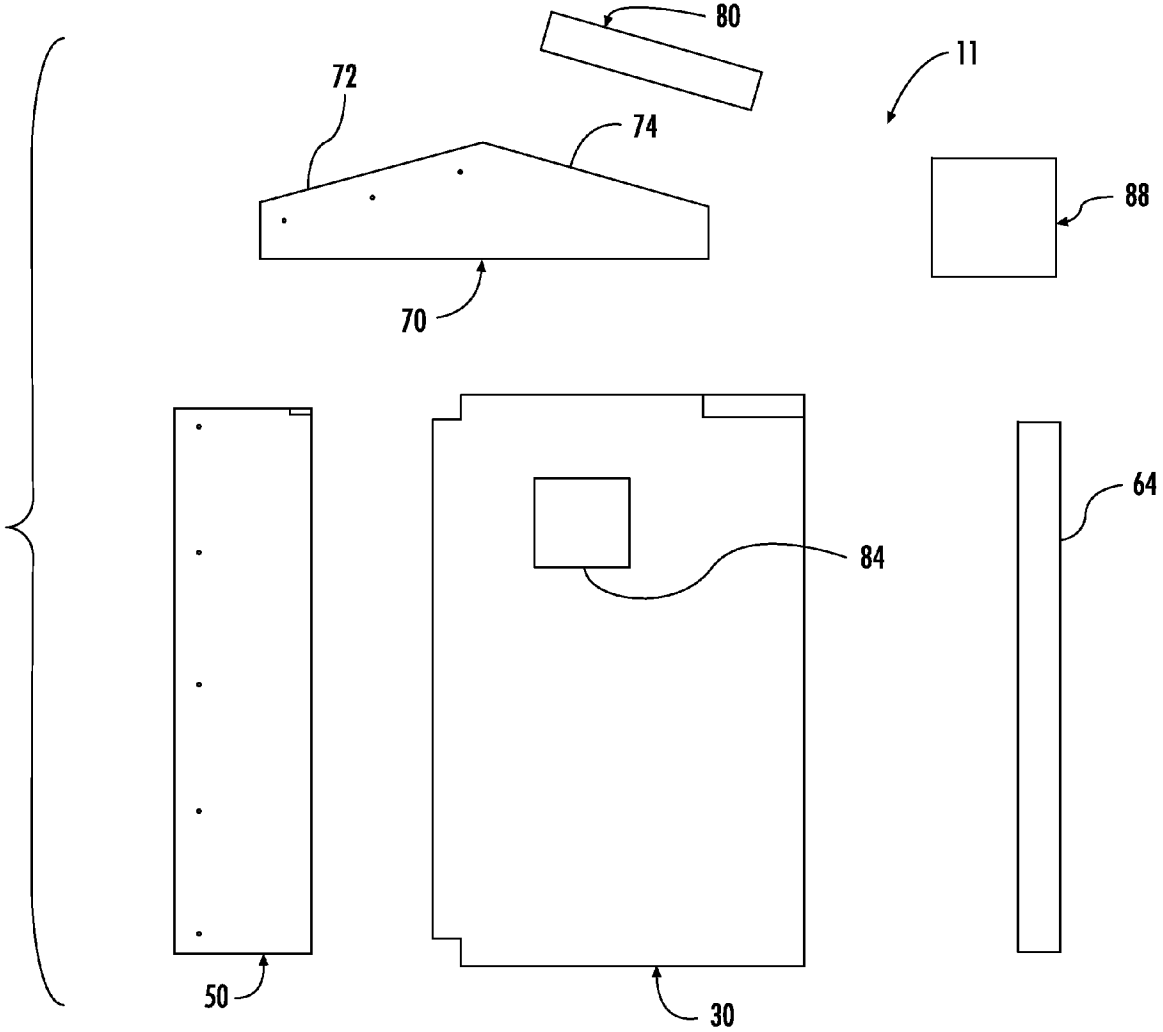
FIG. 9 is a plan view illustrating fabric panels for use in an exemplary modular tent door consistent with the present disclosure.

As illustrated through joint reference to FIGS. 1, 2, and 9, a vestibule header panel 70 of fabric or the like may be secured between the header tube 38 and the vestibule A-frame 48. According to the illustrated exemplary construction, the vestibule header panel 70 may have a generally pyramidal shape with a first lateral edge 72 and a second lateral edge 74 converging to form a peak.

According to one exemplary practice, the vestibule header panel 70 may be secured along the header tube 38 by a multiplicity of rivets 14 as previously described in relation to other fabric panels. Heat welds 75 (FIG. 1) may be used to join the lower edge of the vestibule header panel 70 to the adjacent upper edges of the door skin panel 30 and fabric side panel 50. The vestibule header panel 70 may be may be folded over onto itself along the first lateral edge 72 and seamed to form a pocket adapted for receipt of a first A-frame leg 76. In the illustrated exemplary construction, the outboard edge of the header panel adjacent to the first A-frame leg 76 may include a pattern of rivets 14 (FIG. 1) secured to grommets 52 (FIG. 2) adapted to provide a snap connection along one side of the tent opening. Thus, the grommets 52 disposed adjacent the first vestibule leg pole 46 and the grommets 52 disposed adjacent the first A-frame leg cooperatively form a substantially continuous connection along one half of a surrounding tent vestibule opening.

The vestibule header panel 70 may be may be folded over onto itself along the second lateral edge 74 and seamed to form a pocket adapted for receipt of a second A-frame leg 78. In the exemplary construction, the outboard edge of the vestibule header panel 70 may be seamed or otherwise secured to a flap supporting a multiplicity of Becket loops 60 adapted to be joined in cinched relation to the perimeter of the tent vestibule opening in a manner as will be well known to those of skill in the art. The Becket loops 60 disposed adjacent the second vestibule leg pole 47 and the Becket loops 60 disposed adjacent the second A-frame leg 78 thus cooperatively form a substantially continuous cinched connection along one half of a surrounding tent vestibule opening.

Figure 7:
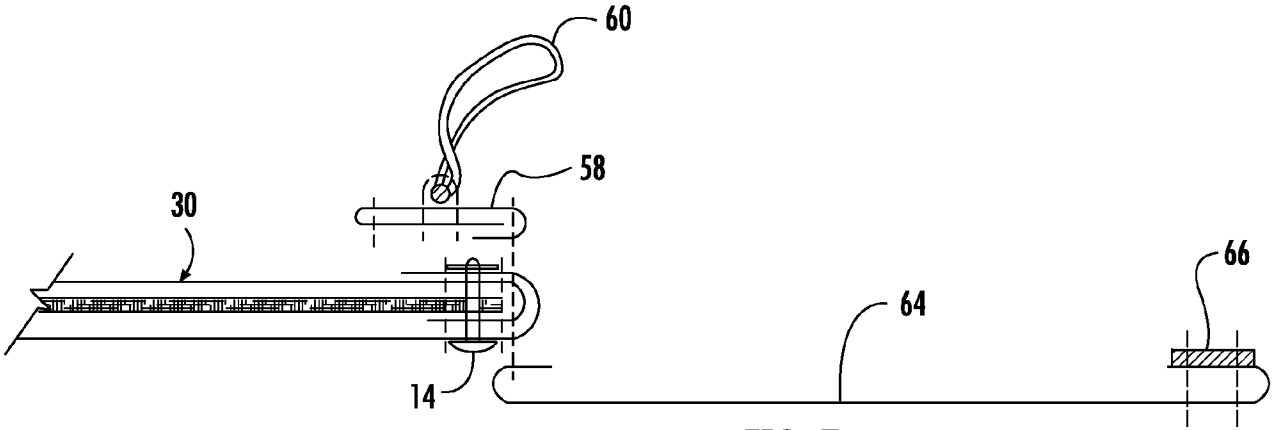
FIG. 7 is a sectional view taken generally along line 7-7 in FIG. 1 illustrating an exemplary Becket loop and weather seal flap arrangement for an exemplary modular tent door consistent with the present disclosure.

According to the illustrated exemplary construction, the second lateral edge 74 of the vestibule header panel 70 may be seamed or otherwise secured to a barrier flap 80 (FIG. 9) similar in construction to the barrier flap 64 such that substantially the same arrangement as illustrated in FIG. 7 is established with an arrangement of Becket loops 60. So as to promote a weather-tight covering at the location of the Becket loop attachments, the barrier flap 80 of PVC coated polyester fabric or the like extends outboard from the edge of the vestibule header panel 70 adjacent the location of the Becket loops. The barrier flap 80 includes a flap connection element 81 along its free edge. By way of example only, the flap connection element 81 may be one half of a hook and loop fabric connection such that the barrier flap 80 may be folded over the Becket loops and be attached to a complementary element. An effective weather cover may thus be established.

As will be understood, the combination of Becket loop attachments forming a perimeter connection structure substantially along one half of the door assembly 10 and grommets forming a perimeter connection structure substantially along an opposing half of the door assembly 10 permits the door assembly to be free of perimeter zipper connections. The avoidance of zipper connections between the door assembly and a surrounding tent is believed to provide substantially improved reliability in harsh environments in which sand and/or rain main may degrade zipper performance over time.

Figure 8:
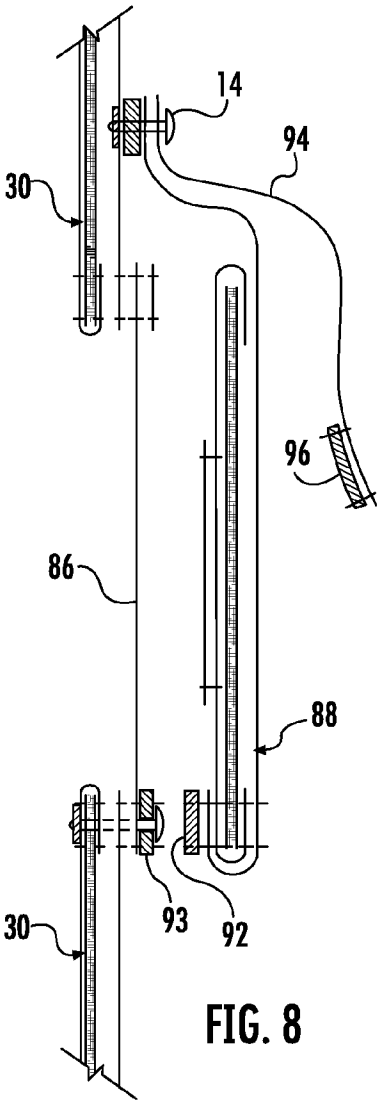
FIG. 8 is a sectional view taken generally along line 8-8 in FIG. 1 illustrating an exemplary door window for a modular tent door consistent with the present disclosure.

As best illustrated through joint reference to FIGS. 1, 2 and 8, the door assembly 10 may include a window port 82 for seeing through the rotatable door 20. By way of example only, and not limitation, the window port 82 may be formed at a cut-out 84 in the door skin panel 30 (FIG. 9). A window pane 86 (FIG. 8) may be secured in place in covering relation to the cut-out 84. A window flap 88 may be secured by rivets 14 or other suitable connections to permit selective displacement of the window flap 88 relative to the pane 86. According to the illustrated exemplary practice, the window flap 88 may be a folded fabric material having a distal edge supporting hook or loop connection material 92 adapted to engage a complementary hook or loop connection material 93 on the window pane 86. Thus, the window flap 88 may be pulled in releasable covering relation over the window pane 86. One or more straps 94 with hook or loop connection material 96 which is complementary to the hook or loop connection material 92 on the window flap 88 may be provided to hold the window flap in rolled-up stowed relation if continuous visibility is desired.

In accordance with an exemplary construction, the door skin panel 30, the fabric side panel 50, the vestibule header panel 70 and the window flap 88 may each have a multi-layer insulated construction. According to one exemplary construction, one or more of these structures may be formed from a polymeric outer fabric 98 of polyester, nylon, or the like with an outer surface coating of PVC or the like disposed in wrap-around relation to one or more layers of an insulating cellular foam 99 such as polyethylene foam or the like having a reflective coating of aluminum or the like on one or both sides oriented to face outwardly away from the interior of the tent. By way of example only, and not limitation, one such insulating cellular material is believed to be available under the trade name LOW-E® sold by Environmentally Safe Products, Inc. having a place of business in New Oxford, Pa. Such a construction is believed to provide substantial protection from intense outside heat, while also containing warmth within the tent when heaters are being used. Of course, virtually any other pliable fabric material may be used if desired.

As will be appreciated, a significant benefit of a modular tent door consistent with the present disclosure is the ability to disengage segments making up the individual frame support members from one another and to then fold the structure. By way of example only, and not limitation, each of the inboard lateral tube sections 22, 23 and each of the outboard lateral tube sections 34, 35 may be formed from multiple rectangular tube segments joined together in the manner as described in U.S. Pat. No. 6,726,255 (incorporated by reference). When these segments are disconnected from one another and the vestibule leg poles 46, 47 are removed, the door skin panel 30 and the fabric side panel 50 may be folded while the individual tubular segments remain riveted to the fabric. Upon reuse, the tube segments are properly positioned and may be easily reconnected. Regardless of the actual geometry of the door panel assembly, the use of the collapsible frame facilitates permits relatively easy and rapid disassembly and compact packaging due to the pliable nature of the covering. Moreover, disassembly and reassembly may be carried out using only a single tightening tool such as a socket wrench or the like.

Of course, variations and modifications of the foregoing are within the scope of the present disclosure. All dimensions are merely exemplary. Thus, it is to be understood that the disclosure disclosed and defined herein extends to all alternative combinations of two or more of the individual features mentioned or evident from the text and/or drawings. All of these different combinations constitute various alternative aspects of the present disclosure.

What is claimed is:

1. A modular tent door panel adapted to be folded and unfolded for storage and shipment, the door panel comprising:

a structural frame including a door skeleton defining a rotatable door adapted to rotate about a hinge line, wherein the door skeleton comprises a plurality of tube sections, wherein one or more of the tube sections are multi-piece tube sections comprising multiple tube segments interconnected in releasable relation to one another along a length dimension, such that the multi-piece tube sections have an enhanced length relative to the tube segments;

a pliable door skin panel disposed in covering relation across one side of the door skeleton, the door skin panel being anchored in fixed relation to multiple tube segments forming a first outboard multi-piece tube section, the first outboard multi-piece tube section being positioned substantially parallel to the hinge line and outboard from the hinge line, the door skin panel being further anchored in fixed relation to multiple tube segments forming an inboard multi-piece tube section comprising a portion of the door skeleton and defining a free edge of the door oriented substantially parallel to the hinge line, wherein a plurality of cinching loops are operatively connected to the door skin panel along an outboard lateral edge of the door skin panel; and a pliable side panel anchored in fixed relation to multiple tube segments forming a second outboard multi-piece tube section, the second outboard multi-piece tube section being positioned substantially parallel to the hinge line and adjacent to and outboard from the free edge of the door when the door is in a closed position, the first outboard multi-piece tube section and the second outboard multi-piece tube section comprising portions of the structural frame and being disposed outboard from the door skeleton adjacent to opposing sides of the door skeleton.

2. The modular tent door panel as recited in claim 1, wherein the door skin panel and the side panel each has a multi-layer construction including an insulating cellular foam layer disposed in sandwiched relation between coated polymeric fabric layers.

3. The modular tent door panel as recited in claim 1, wherein a plurality of grommets are disposed along an interior surface of the side panel adjacent to the outboard lateral edge.

4. The modular tent door panel as recited in claim 1, wherein a pliable barrier flap is fixedly connected to the door skin panel along the outboard lateral edge of the door skin panel.

5. The modular tent door panel as recited in claim 1, wherein a pliable vestibule header panel of substantially triangular geometry is secured at an upper edge of the door skin panel and along an upper edge of the side panel.

6. The modular tent door panel as recited in claim 5, wherein the vestibule header panel has a multi-layer construction including an insulating cellular foam layer disposed in sandwiched relation between coated polymeric fabric layers.

7. The modular tent door panel as recited in claim 5, wherein the vestibule header panel includes a first lateral edge and a second lateral edge converging to define a peak.

8. The modular tent door panel as recited in claim 5, wherein a plurality of grommets are disposed along an interior surface of a first lateral edge of the vestibule header panel.

9. The modular tent door panel as recited in claim 5, wherein a plurality of cinching loops are operatively connected to the vestibule header panel along a second lateral edge of the vestibule header panel.

10. The modular tent door panel as recited in claim 9, wherein a pliable barrier flap is fixedly connected to the vestibule header panel along the second lateral edge of the vestibule header panel.

11. The modular tent door panel as recited in claim 1, further comprising a translucent window pane disposed within the door skin panel.

12. A modular tent door panel adapted to be folded and unfolded for storage and shipment, the door panel comprising:

a structural frame including a door skeleton defining a rotatable door adapted to rotate about a hinge line, wherein the door skeleton comprises a plurality of tube sections, wherein one or more of the tube sections are multi-piece tube sections comprising multiple tube segments interconnected in releasable relation to one another along a length dimension, such that the multi-piece tube sections have an enhanced length relative to the tube segments;

a pliable door skin panel disposed in covering relation across one side of the door skeleton, the door skin panel being anchored in fixed relation to multiple tube segments forming a first outboard multi-piece tube section, the first outboard multi-piece tube section being positioned substantially parallel to the hinge line and outboard from the hinge line, wherein an outboard lateral edge of the door skin panel extends to a position outboard from the first outboard multi-piece tube section, the door skin panel being further anchored in fixed relation to multiple tube segments forming an inboard multi-piece tube section comprising a portion of the door skeleton and defining a free edge of the door oriented substantially parallel to the hinge line;

a pliable side panel having an inboard lateral edge and an outboard lateral edge, the inboard lateral edge being anchored by rivets in fixed relation to multiple tube segments forming a second outboard multi-piece tube section, the second outboard multi-piece tube section being positioned substantially parallel to the hinge line and adjacent to and outboard from the free edge of the door when the door is in a closed position, the first outboard multi-piece tube section and the second outboard multi-piece tube section comprising portions of the structural frame and being disposed outboard from the door skeleton adjacent to opposing sides of the door skeleton;

a plurality of cinching loops operatively connected to the door skin panel along the outboard lateral edge of the door skin panel;

a pliable barrier flap fixedly connected to the door skin panel along the outboard lateral edge of the door skin panel;

a pliable vestibule header panel of substantially triangular geometry secured at an upper edge of the door skin panel and along an upper edge of the side panel, the vestibule header panel having a first lateral edge and a second lateral edge converging to define a peak, wherein a plurality of grommets are disposed along an interior surface of the first lateral edge of the vestibule header panel and wherein a plurality of cinching loops are operatively connected to the vestibule header panel along the second lateral edge of the vestibule header panel with a pliable barrier flap being fixedly connected to the vestibule header panel along the second lateral edge of the vestibule header panel, wherein the door skin panel, the side panel and the vestibule header panel are all free from perimeter zipper attachments.

13. The modular tent door panel as recited in claim 12, wherein the door skin panel and the side panel each has a multi-layer construction including an insulating cellular foam layer disposed in sandwiched relation between coated polymeric fabric layers.

14. The modular tent door panel as recited in claim 13, wherein the cellular foam layer comprises a reflective coating disposed across a surface oriented to face away from the structural frame.

15. The modular tent door panel as recited in claim 12, wherein a plurality of grommets are disposed along an interior surface of the side panel adjacent to the outboard lateral edge.

16. The modular tent door panel as recited in claim 12, wherein the vestibule header panel is welded to an upper edge of the door skin panel and along an upper edge of the side panel.

17. The modular tent door panel as recited in claim 12, wherein the vestibule header panel has a multi-layer construction including an insulating cellular foam layer disposed in sandwiched relation between coated polymeric fabric layers.

18. The modular tent door panel as recited in claim 12, further comprising a translucent window pane disposed within the door skin panel.

19. A modular tent door panel adapted to be folded and unfolded for storage and shipment, the door panel comprising:

a structural frame including a door skeleton defining a rotatable door adapted to rotate about a hinge line, wherein the door skeleton comprises a plurality of rectangular cross-section tube sections, wherein one or more of the tube sections are multi-piece tube sections comprising multiple tube segments interconnected in releasable relation to one another along a length dimension, such that the multi-piece tube sections have an enhanced length relative to the tube segments;

a pliable door skin panel disposed in covering relation across one side of the door skeleton, the door skin panel being anchored by rivets in fixed relation to multiple tube segments forming a first outboard multi-piece tube section, the first outboard multi-piece tube section being positioned substantially parallel to the hinge line and outboard from the hinge line, wherein an outboard lateral edge of the door skin panel extends to a position outboard from the first outboard multi-piece tube section, the door skin panel being further anchored by rivets in fixed relation to multiple tube segments forming an inboard multi-piece tube section comprising a portion of the door skeleton and defining a free edge of the door oriented substantially parallel to the hinge line, the pliable door skin panel having a multi-layer construction including an insulating cellular foam layer disposed in sandwiched relation between coated polymeric fabric layers, the cellular foam layer comprising a reflective coating disposed across a surface oriented to face away from the structural frame;

a pliable side panel having an inboard lateral edge and an outboard lateral edge, the inboard lateral edge being anchored by rivets in fixed relation to multiple tube segments forming a second multi-piece tube section, the second multi-piece tube section being positioned.

* * * * *